US010718523B2

(12) United States Patent
Gubba et al.

(10) Patent No.: US 10,718,523 B2
(45) Date of Patent: Jul. 21, 2020

(54) FUEL INJECTORS WITH MULTIPLE OUTLET SLOTS FOR USE IN GAS TURBINE COMBUSTOR

(71) Applicant: General Electric Company, Schenectady, NY (US)

(72) Inventors: Sreenivasa Rao Gubba, Karnataka (IN); Michael John Hughes, State College, PA (US); Krishna Kant Agarwal, Karnataka (IN)

(73) Assignee: General Electric Company, Schenectady, NY (US)

( * ) Notice: Subject to any disclaimer, the term of this patent is extended or adjusted under 35 U.S.C. 154(b) by 110 days.

(21) Appl. No.: 15/593,561

(22) Filed: May 12, 2017

(65) Prior Publication Data

US 2018/0328587 A1 Nov. 15, 2018

(51) Int. Cl.

| | |
|---|---|
| ***F23R 3/34*** | (2006.01) |
| ***F23D 14/64*** | (2006.01) |
| ***F23R 3/00*** | (2006.01) |
| ***F23R 3/28*** | (2006.01) |
| ***F23R 3/10*** | (2006.01) |

(52) U.S. Cl.

CPC ..... *F23R 3/286* (2013.01); *F23D 14/64* (2013.01); *F23R 3/002* (2013.01); *F23R 3/10* (2013.01); *F23R 3/283* (2013.01); *F23R 3/346* (2013.01); *F23R 2900/03341* (2013.01)

(58) Field of Classification Search

None

See application file for complete search history.

(56) References Cited

U.S. PATENT DOCUMENTS

| | | | |
|---|---|---|---|
| 4,903,480 | A | 2/1990 | Lee et al. |
| 5,220,787 | A | 6/1993 | Bulman |
| 5,640,851 | A | 6/1997 | Toon et al. |
| 6,868,676 | B1 | 3/2005 | Haynes |
| 6,915,636 | B2 | 7/2005 | Stuttaford et al. |
| 7,665,309 | B2 | 2/2010 | Parker et al. |
| 7,878,000 | B2 | 2/2011 | Mancini et al. |

(Continued)

FOREIGN PATENT DOCUMENTS

WO WO-2010081612 A1 * 7/2010 ..... F23R 3/20

OTHER PUBLICATIONS

European Search Report for corresponding EP Application Serial No. 18171676.2, dated Sep. 3, 2018.

*Primary Examiner* — Steven M Sutherland
*Assistant Examiner* — Rodolphe Andre Chabreyrie
(74) *Attorney, Agent, or Firm* — Charlotte C. Wilson; James W. Pemrick

(57) ABSTRACT

A fuel injector includes a frame and a pair of fuel injection bodies coupled to the frame. The frame has interior sides that define an opening for passage of a first fluid. Inlet flow paths for the first fluid are defined at least between the interior sides of the frame and the respective fuel injection bodies. Each fuel injection body defines a fuel plenum and includes at least one fuel injection surface that defines a plurality of fuel injection holes in communication with the fuel plenum. An outlet member is located downstream of, and in fluid communication, with the inlet flow paths. The outlet member is configured to produce discrete outlet flow paths exiting the outlet member via struts, flow diverters, and/or separate outlet members.

10 Claims, 9 Drawing Sheets

(56) References Cited

U.S. PATENT DOCUMENTS

| | | | | |
|---|---|---|---|---|
| 8,113,001 | B2 | 2/2012 | Singh et al. | |
| 8,171,735 | B2 | 5/2012 | Mancini et al. | |
| 8,387,391 | B2 | 3/2013 | Patel et al. | |
| 8,438,856 | B2 | 5/2013 | Chila et al. | |
| 8,590,311 | B2 | 11/2013 | Parsania et al. | |
| 8,745,987 | B2 | 6/2014 | Stoia et al. | |
| 8,763,400 | B2 | 7/2014 | Bunker | |
| 8,863,525 | B2 | 10/2014 | Toronto et al. | |
| 9,267,436 | B2 | 2/2016 | Stoia et al. | |
| 9,291,350 | B2 | 3/2016 | Melton et al. | |
| 9,303,872 | B2 | 4/2016 | Hadley et al. | |
| 9,316,155 | B2 | 4/2016 | DiCintio et al. | |
| 9,316,396 | B2 | 4/2016 | DiCintio et al. | |
| 9,322,556 | B2 | 4/2016 | Melton et al. | |
| 9,360,217 | B2 | 6/2016 | DiCintio et al. | |
| 9,376,961 | B2 | 6/2016 | Stoia et al. | |
| 9,383,104 | B2 | 7/2016 | Melton et al. | |
| 9,400,114 | B2 | 7/2016 | Melton et al. | |
| 2009/0113895 | A1* | 5/2009 | Steele | F01D 1/026 60/780 |
| 2010/0229557 | A1* | 9/2010 | Matsumoto | F23R 3/34 60/737 |
| 2013/0067921 | A1* | 3/2013 | Hadley | F23R 3/20 60/746 |
| 2013/0174558 | A1* | 7/2013 | Stryapunin | F23R 3/286 60/734 |
| 2014/0260280 | A1 | 9/2014 | Willis et al. | |
| 2014/0260318 | A1 | 9/2014 | Willis et al. | |
| 2014/0360193 | A1 | 12/2014 | Stoia et al. | |
| 2016/0047317 | A1 | 2/2016 | Willis et al. | |
| 2017/0009651 | A1 | 1/2017 | Syed et al. | |

* cited by examiner 10
54
30
24
20
26
24
30
54
22
22
22
30
30
104
104
32
12
12
14
14
36
36
36

FUEL INJECTORS WITH MULTIPLE OUTLET SLOTS FOR USE IN GAS TURBINE COMBUSTOR

TECHNICAL FIELD

The present disclosure relates generally to fuel injectors for gas turbine combustors and, more particularly, to fuel injectors for use with an axial fuel staging (AFS) system associated with such combustors.

BACKGROUND

At least some known gas turbine assemblies include a compressor, a combustor, and a turbine. Gas (e.g., ambient air) flows through the compressor, where the gas is compressed before delivery to one or more combustors. In each combustor, the compressed air is combined with fuel and ignited to generate combustion gases. The combustion gases are channeled from each combustor to and through the turbine, thereby driving the turbine, which, in turn, powers an electrical generator coupled to the turbine. The turbine may also drive the compressor by means of a common shaft or rotor.

In some combustors, the generation of combustion gases occurs at two, axially spaced stages. Such combustors are referred to herein as including an "axial fuel staging" (AFS) system, which delivers fuel and an oxidant to one or more downstream fuel injectors. In a combustor with an AFS system, a primary fuel nozzle at an upstream end of the combustor injects fuel and air (or a fuel/air mixture) in an axial direction into a primary combustion zone, and an AFS fuel injector located at a position downstream of the primary fuel nozzle injects fuel and air (or a second fuel/air mixture) in a radial direction into a secondary combustion zone downstream of the primary combustion zone. In some cases, it is desirable to introduce the fuel and air into the secondary combustion zone as a mixture. Therefore, the mixing capability of the AFS injector influences the overall operating efficiency and/or emissions of the gas turbine.

SUMMARY

The present disclosure is directed to an AFS fuel injector for delivering a mixture of fuel and air in a radial direction into a combustor, thereby producing a secondary combustion zone.

A fuel injector includes a frame and a pair of fuel injection bodies coupled to the frame. The frame has interior sides that define an opening for passage of a first fluid. Inlet flow paths for the first fluid are defined at least between the interior sides of the frame and the respective fuel injection bodies. Each fuel injection body defines a fuel plenum and includes at least one fuel injection surface that defines a plurality of fuel injection holes in communication with the fuel plenum. An outlet member is located downstream of, and in fluid communication, with the inlet flow paths. The outlet member is configured to produce discrete, or separate, outlet flow paths exiting the outlet member via struts, flow diverters, and/or separate outlet members.

BRIEF DESCRIPTION OF THE DRAWINGS

A full and enabling disclosure of the present products and methods, including the best mode thereof, directed to one of ordinary skill in the art, is set forth in the specification, which makes reference to the appended figures, in which.

DETAILED DESCRIPTION

The following detailed description illustrates various fuel injectors, their component parts, and methods of fabricating the same, by way of example and not limitation. The description enables one of ordinary skill in the art to make and use the fuel injectors. The description provides several embodiments of the fuel injectors, including what is presently believed to be the best modes of making and using the fuel injectors. An exemplary fuel injector is described herein as being used within a combustor of a heavy-duty gas turbine assembly coupled to a generator for electrical power generation. However, it is contemplated that the fuel injectors described herein have general application to a broad range of systems in a variety of fields other than electrical power generation.

As used herein, the term "radius" (or any variation thereof) refers to a dimension extending outwardly from a center of any suitable shape (e.g., a square, a rectangle, a triangle, etc.) and is not limited to a dimension extending outwardly from a center of a circular shape. Similarly, as used herein, the term "circumference" (or any variation thereof) refers to a dimension extending around a center of any suitable shape (e.g., a square, a rectangle, a triangle, etc.) and is not limited to a dimension extending around a center of a circular shape.

Figure 1:
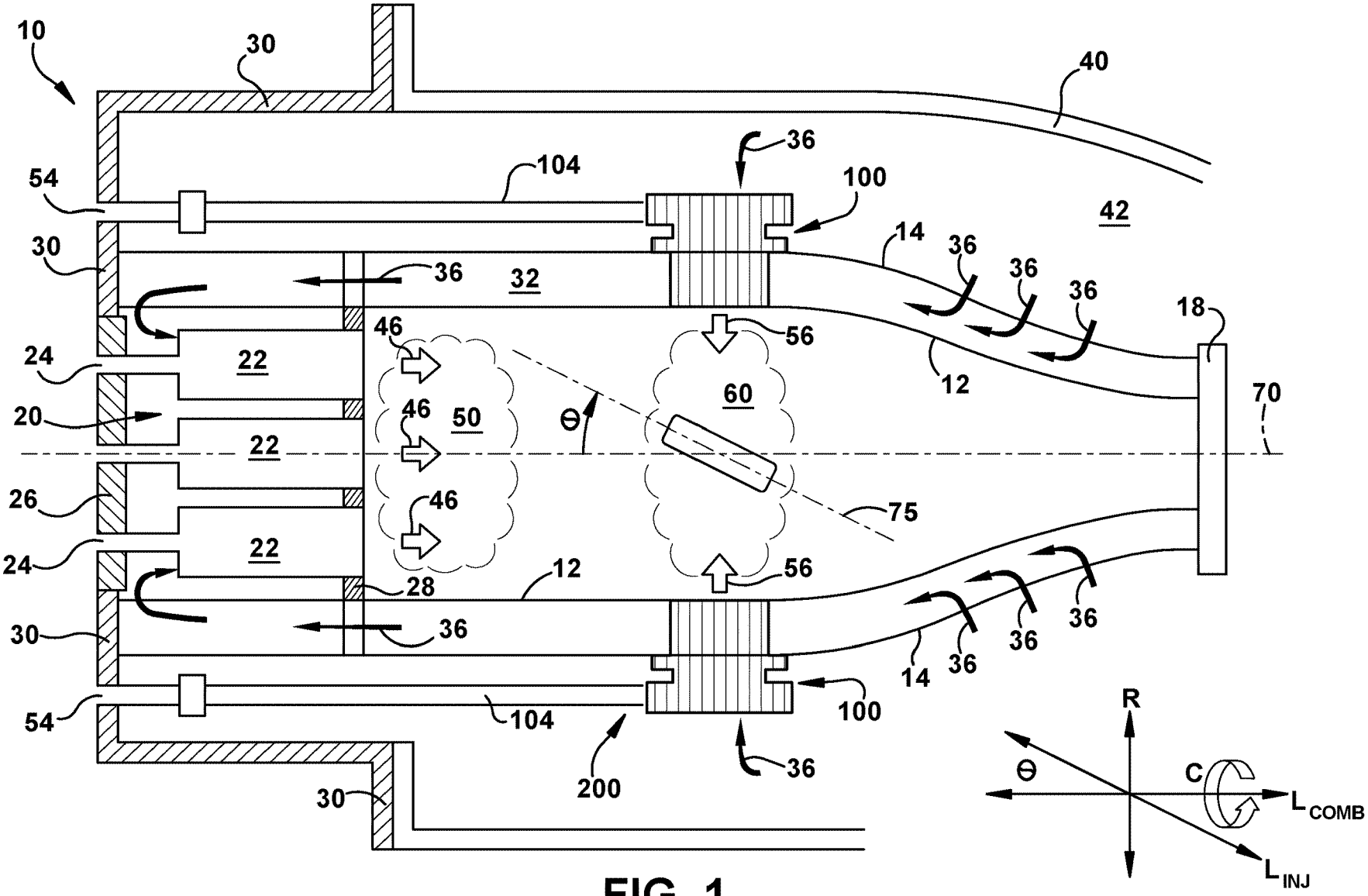
FIG. 1 is a schematic cross-sectional side view of a combustion can, including a downstream fuel injector according to the present disclosure.

FIG. 1 is a schematic representation of a combustion can 10, as may be included in a can annular combustion system for a heavy duty gas turbine. In a can annular combustion system, a plurality of combustion cans 10 (e.g., 8, 10, 12, 14, 16, or more) are positioned in an annular array about a rotor that connects a compressor to a turbine. The turbine may be operably connected (e.g., by the rotor) to a generator for producing electrical power.

In FIG. 1, the combustion can 10 includes a liner 12 that contains and conveys combustion gases 66 to the turbine. The liner 12 may have a cylindrical liner portion and a tapered transition portion that is separate from the cylindrical liner portion, as in many conventional combustion systems. Alternately, the liner 12 may have a unified body (or "unibody") construction, in which the cylindrical portion and the tapered portion are integrated with one another in a single piece. Thus, any discussion of the liner 12 herein is intended to encompass both conventional combustion systems having a separate liner and transition piece and those combustion systems having a unibody liner. Moreover, the present disclosure is equally applicable to those combustion systems in which the transition piece and the stage one nozzle of the turbine are integrated into a single unit, sometimes referred to as a "transition nozzle" or an "integrated exit piece."

The liner 12 is at least partially surrounded by an outer sleeve 14, which is spaced radially outward of the liner 12 to define an annulus 32 between the liner 12 and the outer sleeve 14. The outer sleeve 14 may include a flow sleeve portion at the forward end and an impingement sleeve portion at the aft end, as in many conventional combustion systems. Alternately, the outer sleeve 14 may have a unified body (or "unisleeve") construction, in which the flow sleeve portion and the impingement sleeve portion are integrated with one another in the axial direction. As before, any discussion of the outer sleeve 14 herein is intended to encompass both convention combustion systems having a separate flow sleeve and impingement sleeve and combustion systems having a unisleeve outer sleeve.

A head end portion 20 of the combustion can 10 includes one or more fuel nozzles 22. The fuel nozzles 22 have a fuel inlet 24 at an upstream (or inlet) end. The fuel inlets 24 may be formed through an end cover 26 at a forward end of the combustion can 10. The downstream (or outlet) ends of the fuel nozzles 22 extend through a combustor cap 28 that radially spans the head end portion 20 and that separates the head end 20 from a primary combustion zone 50.

The head end portion 20 of the combustion can 10 is at least partially surrounded by a forward casing 30, which is physically coupled and fluidly connected to a compressor discharge case 40. The compressor discharge case 40 is fluidly connected to an outlet of the compressor (not shown) and defines a pressurized air plenum 42 that surrounds at least a portion of the combustion can 10. Air 36 flows from the compressor discharge case 40 into the annulus 32 at an aft end of the combustion can. Because the annulus 32 is fluidly coupled to the head end portion 20, the air flow 36 travels upstream from the aft end of the combustion can 10 to the head end portion 20, where the air flow 36 reverses direction and enters the fuel nozzles 22.

Fuel and air are introduced by the fuel nozzles 22 into the primary combustion zone 50 at a forward end of the liner 12, where the fuel and air are combusted to form combustion gases 46. In one embodiment, the fuel and air are mixed within the fuel nozzles 22 (e.g., in a premixed fuel nozzle). In other embodiments, the fuel and air may be separately introduced into the primary combustion zone 50 and mixed within the primary combustion zone 50 (e.g., as may occur with a diffusion nozzle). Reference made herein to a "first fuel/air mixture" should be interpreted as describing both a premixed fuel/air mixture and a diffusion-type fuel/air mixture, either of which may be produced by fuel nozzles 22.

The combustion gases 46 travel downstream toward an aft end of the combustion can 10, represented by an aft frame 18. Additional fuel and air are introduced, as a second fuel/air mixture 56, by one or more fuel injectors 100 into a secondary combustion zone 60, where the fuel and air 56 are ignited by the combustion gases 46 to form a combined combustion gas product stream 66. Such a combustion system having axially separated combustion zones is described as an "axial fuel staging" (AFS) system 200, and the downstream injectors 100 may be referred to as "AFS injectors."

In the embodiment shown, fuel for each AFS injector 100 is supplied from the head end of the combustion can 10, via a fuel inlet 54. Each fuel inlet 54 is coupled to a fuel supply line 104, which is coupled to a respective AFS injector 100. It should be understood that other methods of delivering fuel to the AFS injectors 100 may be employed, including supplying fuel from a ring manifold or from radially oriented fuel supply lines that extend through the compressor discharge case 40.

FIG. 1 further shows that the AFS injectors 100 may optionally be oriented at an angle θ (theta) relative to the longitudinal center line 70 of the combustion can 10. In the embodiment shown, the leading edge portion of the injector 100 (that is, the portion of the injector 100 located most closely to the head end) is oriented away from the center line 70 of the combustion can 10, while the trailing edge portion of the injector 100 is oriented toward the center line 70 of the combustion can 10. The angle θ, defined between the longitudinal axis 75 of the injector 100 and the center line 70, may be between 0 degrees and 45 degrees, between 1 degree and 30 degrees, between 1 degree and 20 degrees, or between 1 degree and 10 degrees, or any intermediate value therebetween. In other embodiments, it may be desirable to orient the injector 100, such that the leading edge portion is proximate the center line 70, and the trailing edge portion is distal to the center line 70.

The injectors 100 inject the second fuel/air mixture 56, in a radial direction, through the combustion liner 12, thereby forming a secondary combustion zone 60 axially spaced from the primary combustion zone 50. The combined hot gases 66 from the primary and secondary combustion zones travel downstream through the aft end 18 of the combustor can 10 and into the turbine section, where the combustion gases 66 are expanded to drive the turbine.

Notably, to enhance the operating efficiency of the gas turbine and to reduce emissions, it is desirable for the injector 100 to thoroughly mix fuel and compressed gas to form the second fuel/air mixture 56 and to quickly introduce the fuel/air mixture 56 as a cross-flow into the flow of combustion gases 46. Thus, the injector embodiments described below facilitate improved mixing and increase the surface area of the flame produced by the injector 100. As a result, a higher volume of fuel may be introduced via the injectors 100, and the length of the liner 12 may be shortened.

Figure 2:
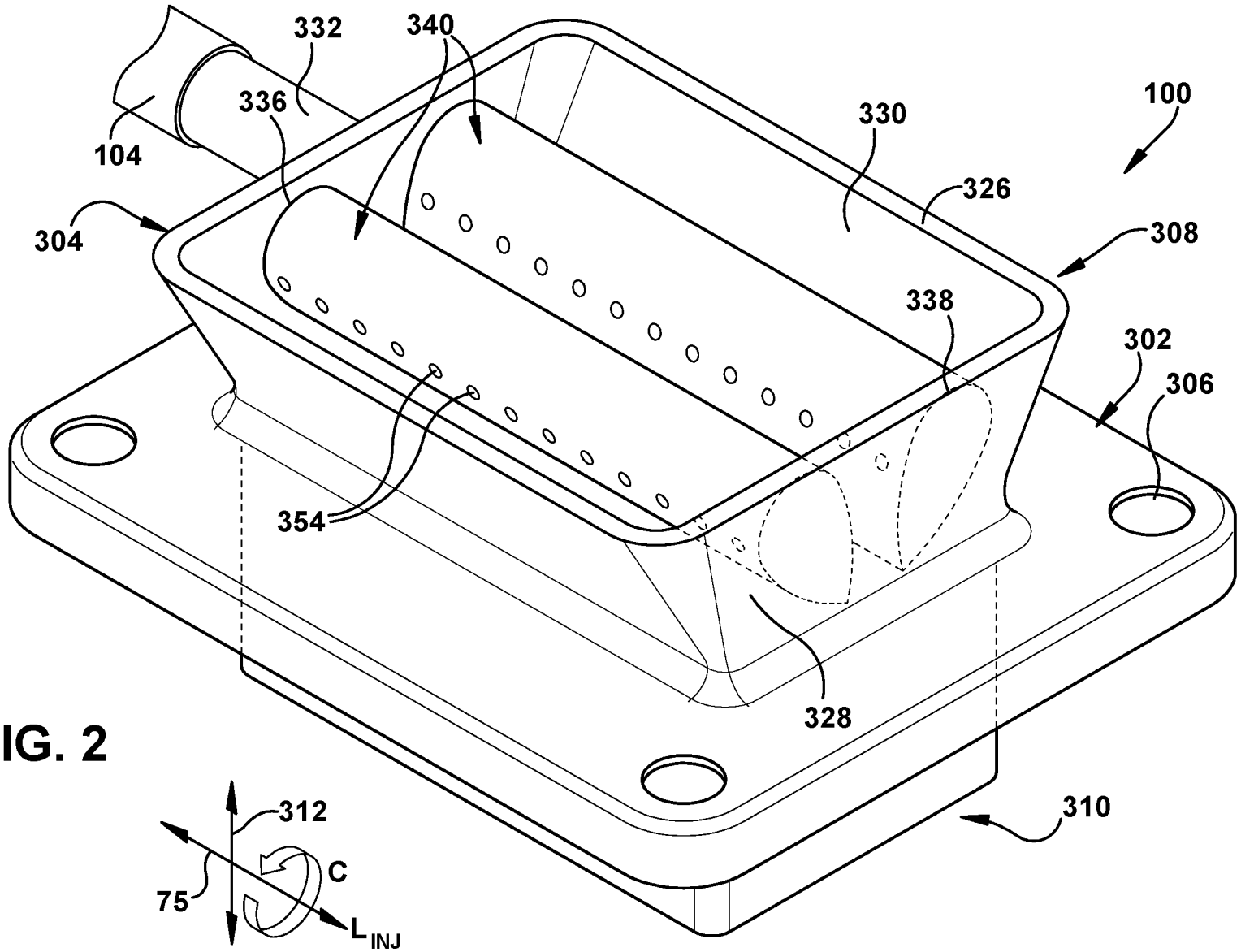
FIG. 2 is a perspective view of a fuel injector having a pair of fuel injection bodies, according to one aspect of the present disclosure.
Figure 4:
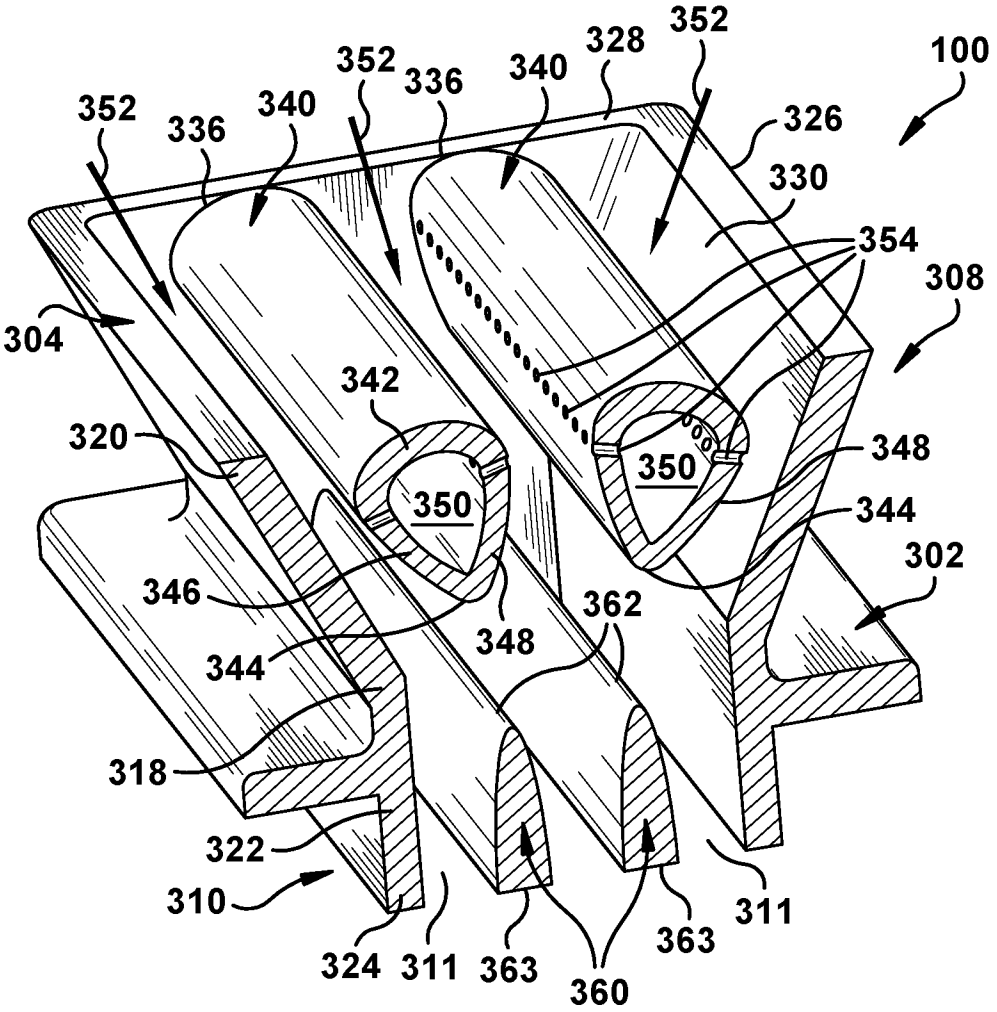
FIG. 4 is a cross-sectional perspective view of the fuel injector of FIG. 2.
Figure 3:
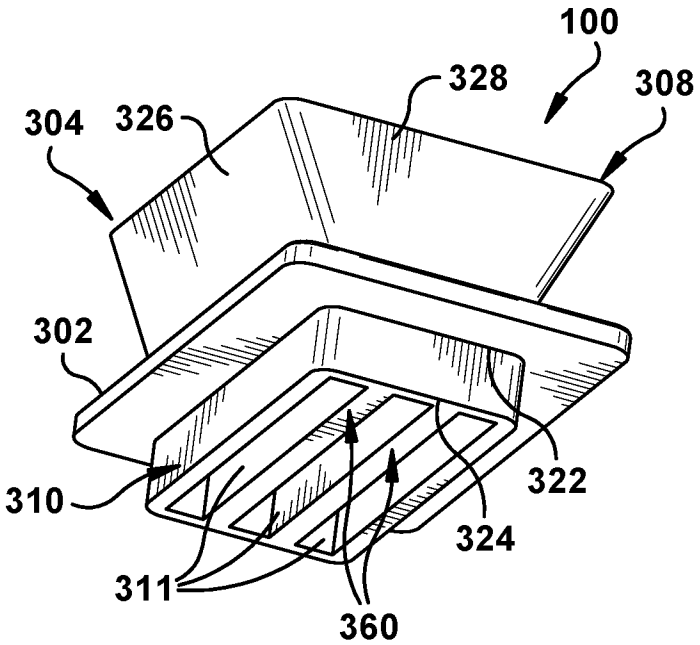
FIG. 3 is a bottom perspective view of the fuel injector of FIG. 2.

FIGS. 2, 3, and 4 illustrate an exemplary fuel injector 100 for use in the AFS system 200 described above. In the exemplary embodiment, the fuel injector 100 includes a mounting flange 302, a frame 304, and an outlet member 310 that are coupled together. In one embodiment, the mounting flange 302, the frame 304, and the outlet member 310 are manufactured as a single-piece structure (that is, are formed integrally with one another). Alternately, in other embodiments, the flange 302 may not be formed integrally with the frame 304 and/or the outlet 310 (e.g., the flange 302 may be coupled to the frame 304 and/or the outlet 302 using suitable fasteners or joining techniques). Moreover, the frame 304 and the outlet 302 may be made as an integrated, single-piece unit, which is separately joined to the flange 302 (e.g., by interlocking members).

The flange 302, which is generally planar, defines a plurality of apertures 306 that are each sized to receive a fastener (not shown) for coupling the fuel injector 100 to the outer sleeve 14. The fuel injector 100 may have any suitable structure in lieu of, or in combination with, the flange 302 (e.g., a boss) that enables the frame 304 to be coupled to the outer sleeve 14, such that the injector 100 functions in the manner described herein.

The frame 304 defines the inlet portion of the fuel injector 100. The frame 304 includes a first pair of oppositely disposed side walls 326 and a second pair of oppositely disposed end walls 328. The side walls 326 are longer than the end walls 328, thus providing the frame 304 with a generally rectangular profile in the axial direction. The frame 304 has a generally trapezoid-shaped profile in the radial direction (that is, side walls 326 are angled with respect to the flange 302). The frame 304 has a first end 318 proximal to the flange 302 ("a proximal end") and a second end 320 distal to the flange 302 ("a distal end"). The first ends 318 of the side walls 326 are spaced further from a longitudinal axis of the fuel injector 100 ($L_{INJ}$) than the second ends of the side walls 326, when compared in their respective longitudinal planes.

The outlet member 310 extends radially from the flange 302 on a side opposite the frame 304. The outlet member 310 provides fluid communication between the frame 304 and the interior of the liner 12 and delivers the second fuel/air mixture 56 into the secondary combustion zone 60. The outlet member 310 has a first end 322 proximal to the flange 302 and a second end 324 distal to the flange 302 (and proximal to the liner 12), when the fuel injector 100 is installed. Further, when the fuel injector 100 is installed, the outlet member 310 is located within the annulus 32 between the liner 12 and the outer sleeve 14, such that the flange 302 is located on an outer surface of the outer sleeve 14 (as shown in FIG. 1).

In the illustrated embodiment, the outlet member 310 includes a pair of struts 360 extending longitudinally across the outlet member 310. The struts 360 have an aerodynamic shape that diverges relative to the direction of air flow through the injector 100. That is, the struts have a leading edge 362 proximal the fuel injection bodies 340 and a trailing edge 363 near the distal end 324 of the outlet member 310. The struts 360 and the outlet member 310 define three slot-shaped outlet flow paths 311 ("outlet slots") through which the fuel/air mixture 56 is conveyed into the combustor 10. The outlet flow paths 311 are discrete, or separate, from one another.

The fuel/air mixture is conveyed along multiple parallel injection axes (generally labeled 312 in FIG. 2). The injection axes 312 are generally linear. The injection axes 312 represent a radial dimension "R" with respect to the longitudinal axis 70 of the combustion can 10 ($L_{COMB}$). The fuel injector 100 further includes a longitudinal dimension (represented as axis $L_{INJ}$), which is generally perpendicular to the injection axis 312, and a circumferential dimension "C" extending about the longitudinal axis $L_{INJ}$. As described above, the longitudinal axis $L_{INJ}$ of the injector 100 may be coincident with the longitudinal axis of the combustion can $L_{COMB}$, or may be off-set from the longitudinal axis of the combustion can $L_{COMB}$.

Thus, the frame 304 extends radially outward from the flange 302 in a first direction, and the outlet member 310 extends radially inward from the flange 302 in a second direction opposite the first direction. The flange 302 extends circumferentially around (that is, circumscribes) the frame 304. The frame 304 and the outlet member 310 extend circumferentially about the injection axes 312 and are in flow communication with one another across the flange 302.

Although the embodiments illustrated herein present the flange 302 as being located between the frame 304 and the outlet member 310, it should be understood that the flange 302 may be located at some other location or in some other suitable orientation. For instance, the frame 304 and the outlet member 310 may not extend from the flange 302 in generally opposite directions.

In one exemplary embodiment, the distal end 320 of inlet member 308 may be wider than the proximal end 318 of the frame 304, such that the frame 304 is at least partly tapered (or funnel-shaped) between the distal end 320 and the proximal end 318. Said differently, in the exemplary embodiment described above, the sides 326 converge in thickness from the distal end 320 to the proximal end 318.

Further, as shown in FIGS. 2, 3, and 4, the side walls 326 of the frame 304 are oriented at an angle with respect to the flange 302, thus causing the frame 304 to converge from the distal end 320 to the proximal end 318 of the side walls 326. In some embodiments, the end walls 328 may also or instead be oriented at an angle with respect to the flange 302. The side walls 326 and the end walls 328 have a generally linear cross-sectional profile. In other embodiments, the side walls 326 and the end walls 328 may have any suitable cross-sectional profile(s) that enables the frame 304 to be at least partly convergent (i.e., tapered) between distal end 320 and proximal end 318 (e.g., at least one side wall 326 may have a cross-sectional profile that extends arcuately between ends 320 and 318). Alternatively, the frame 304 may not taper between distal end 320 and proximal end 318 (e.g., in other embodiments, when the side walls 326 and the end walls 328 may each have a substantially linear cross-sectional profile that are oriented substantially parallel to the central injection axis 312).

In the exemplary embodiment, the fuel injector 100 further includes a conduit fitting 332 (shown in FIG. 2) and a pair of fuel injection bodies 340 (shown in FIGS. 2 and 4). The conduit fitting 332 is formed integrally with one of the end walls 328 of the frame 304. In one embodiment, the conduit fitting 332 extends generally outward along the longitudinal axis ($L_{INJ}$) of the injector 100. The conduit fitting 332 is connected to the fuel supply line 104 (also shown in FIG. 1) and receives fuel therefrom. The conduit fitting 332 may have any suitable size and shape, and may be formed integrally with, or coupled to, any suitable portion(s) of the frame 304 that enable the conduit fitting 332 to function as described herein (e.g., the conduit fitting 332 may be formed integrally with a side wall 326 in some embodiments).

Each fuel injection body 340 has a first end 336 that is formed integrally with the end wall 328 from which the conduit fitting 332 projects and a second end 338 that is formed integrally with the end wall 328 on the opposite end of the fuel injector 100 (i.e., the downstream end, relative to the flow of combustion products 60 through the combustor can 10). Each fuel injection body 340, which extends generally linearly across the frame 304 between the end walls 328, defines an internal fuel plenum 350 that is in fluid communication with the conduit fitting 332. In other embodiments, the fuel injection bodies 340 may extend across the frame 304 from any suitable portions of the frame 304 that enable the fuel injection bodies 340 to function as described herein (e.g., the fuel injection bodies 340 may extend between the side walls 326). Alternately, or additionally, the fuel injection bodies 340 may define an arcuate shape between oppositely disposed walls (326 or 328).

As mentioned above, each fuel injection body 340 has a plurality of surfaces that form a hollow structure that defines the internal plenum 350 and that extends between the end walls 328 of the frame 304. When viewed in a cross-section taken from perpendicular to the longitudinal axis $L_{INJ}$, each fuel injection body 340 (in the present embodiment) generally has the shape of an inverted teardrop with a curved leading edge 342, an oppositely disposed trailing edge 344, and a pair of opposing fuel injection surfaces 346, 348 that extend from the leading edge 342 to the trailing edge 344. The fuel plenum 350 does not extend into the flange 302 or within the frame 304 (other than the fluid communication through the end wall 328 into the conduit fitting 332).

Each fuel injection surface 346, 348 includes a plurality of fuel injection ports 354 that provide fluid communication between the internal plenum 350 and one of the respective flow paths 352. The fuel injection ports 354 are spaced along the length of the fuel injection surfaces 346, 348, for example, in any manner (e.g., one or more rows) suitable to enable the fuel injection body 340 to function as described herein.

Each fuel injection body 340 is oriented such that the leading edge 342 is proximate the distal end 320 of the side walls 326 (i.e., the leading edge 342 faces away from the proximal end 318 of the side walls 326). The trailing edge 344 is located proximate the proximal end 318 of the side walls 326 (i.e., the trailing edge 344 faces away from the distal end 320 of the side walls 326). Thus, the trailing edge 344 is in closer proximity to the flange 302 than is the leading edge 342.

Inlet flow paths 352 receive compressed air 36 from the plenum 42 defined within the compressor discharge case 40. The inlet flow paths 352 are defined between an interior surface 330 of the first side wall 326 and a fuel injection surface 346 of a first fuel injection body 340; between the fuel injection surface 348 of the first fuel injection body 340 and the fuel injection surface 346 of a second fuel injection body 340; and between the fuel injection surface 348 of the second fuel injection body and the respective interior surface 330 of the second side wall 326. While the inlet flow paths 352 are shown as being of uniform dimensions from the distal end 320 of the frame 304 to the proximal end 318 of the frame 304, it should be understood that the flow paths 352 may converge from the distal end 320 to the proximal end 318, thereby accelerating the flow. The inlet flow paths 352 intersect downstream of the trailing edge 344 of the fuel injection bodies 340 and upstream of the struts 360, which subsequently divide the flow into discrete, or separate, streams discharged from the outlet flow paths 311 at the distal end 324 of the outlet member 310.

Notably, the fuel injector may have more than two fuel injection bodies 340 extending across the frame 304 in any suitable orientation that defines a suitable number of flow paths 352. For example, in the embodiment shown in FIGS. 5 through 12, the fuel injector 110 includes three adjacent fuel injection bodies 340 that define four spaced inlet flow paths 352 within the frame 304. In one embodiment, the flow paths 352 are equally spaced, as results from the fuel injection bodies 340 being oriented at the same angle with respect to the injection axis 312. Each fuel injection body 340 includes a plurality of fuel injection ports 354 on at least one fuel injection surface 346 or 348, as described above, such that the fuel injection ports 354 are in fluid communication with a respective plenum 350 defined within each fuel injection body 340. In turn, the plenums 350 are in fluid communication with the conduit fitting 332 (shown in FIG. 2), which receives fuel from the fuel supply line 104.

The fuel injector 110 includes an inlet portion 308 that is defined by the frame 304. The frame 304 includes the pair of oppositely disposed side walls 326 and the pair of oppositely disposed end walls 328, such that the frame 304 has a generally rectangular shape at a plane drawn parallel to the mounting flange 302. The fuel conduit fitting 332 (shown in FIG. 2) directs fuel into each of the three fuel injection bodies 340. Fuel is delivered from the fuel injection bodies 340, via the plurality of fuel injection ports 354, into one of four inlet flow paths 352 that are defined (left-to-right in FIG. 7) between an interior surface 330 of a first side wall 326 and a first fuel injection surface 346 of a first fuel injection body 340; between a second fuel injection surface 348 of the first fuel injection body 340 and a respective first fuel injection surface 346 of a second fuel injection body 340; between the respective second fuel injection surface 348 of the second fuel injection body 340 and a respective first fuel injection surface 346 of a third fuel injection body 340; and between a respective second fuel injection surface 348 of the third fuel injection body 340 and an interior surface 330 of the second side wall 326.

The fuel injector 110 further includes an outlet member 310 like that shown in FIGS. 2 through 4. The outlet member 310 projects radially inward from the mounting flange 302 toward the combustor liner 12 (shown in FIG. 1). As illustrated, the inlet flow paths 352 are directed into a mixing chamber 370 upstream of the pair of aerodynamic-shaped struts 360. The shape of the struts 360, in conjunction with one another and the respective side walls of the outlet member 310, creates a series of outlet flow paths 311 that converge along the respective injection axis 312, thus accelerating the flow of the fuel/air mixture 56 out of the injector 110 (or 100) as parallel and axially aligned streams entering the combustion can 10.

Figure 7:
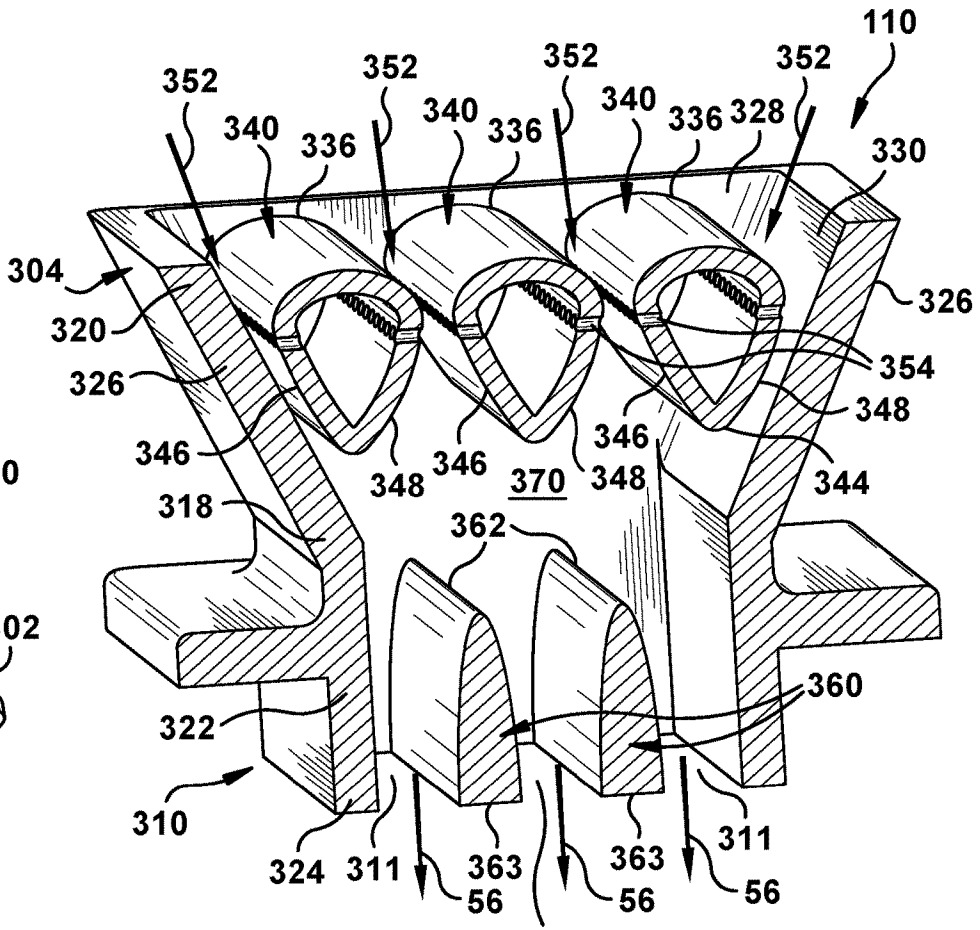
FIG. 7 is a cross-sectional perspective view of the fuel injector of FIGS. 5 and 6.
Figure 5:
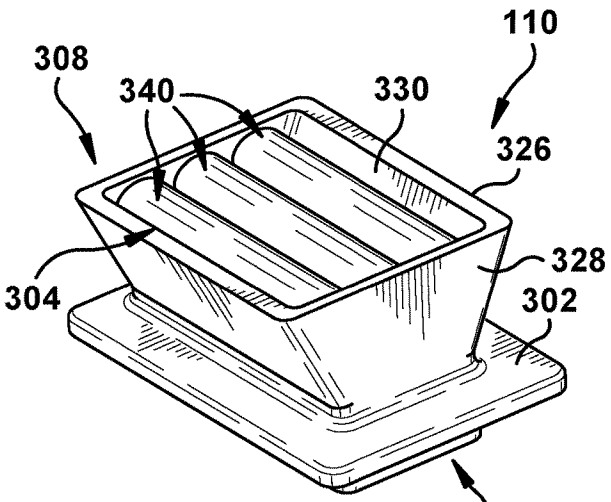
FIG. 5 is a perspective view of a fuel injector having three fuel injection bodies, according to another aspect of the present disclosure.
Figure 6:
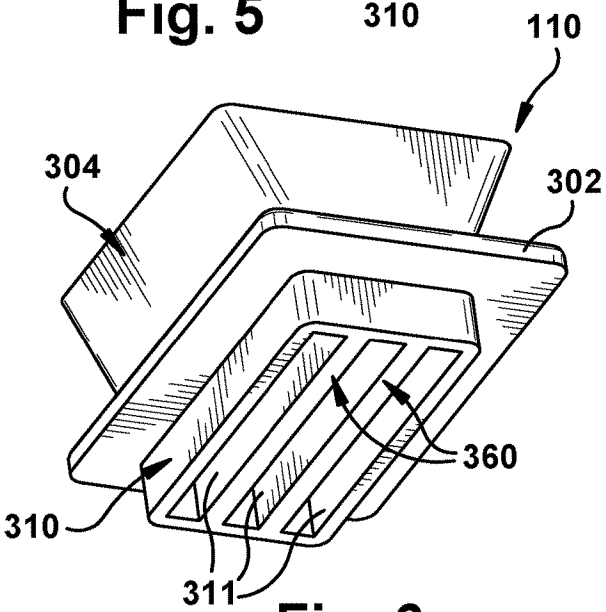
FIG. 6 is a bottom perspective view of the fuel injector of FIG. 5, according to one embodiment.

A variation of the injector 110 shown in FIGS. 5 through 7 is shown as fuel injector 120 in FIGS. 8 through 12. In one embodiment, the inlet portion 308 of the fuel injector 120 is identical to that shown in FIGS. 5 and 7. The outlet portion 310 defines a generally rectangular shape complementary to the shape of the inlet portion 308. The outlet portion 310 includes a leading edge end wall 412 and a trailing edge end wall 414, which are connected to respective outlet side walls 416. It may be observed that a pair of struts 365, 366 extend longitudinally across the outlet member 310 from the leading edge end wall 412 to the trailing edge end wall 414, and a pair of flow diverters 364, 367 may be disposed along the outlet side walls 416.

The struts 365, 366 are shaped differently from the aerodynamic struts 360 discussed previously, such that the streams of the fuel/air mixture 56 exiting the fuel injector 120 diverge away from the longitudinal axis of the injector ($L_{INJ}$) from the leading edge end wall 412 to the trailing edge end wall 414. That is, the outlet slots 311 proximate the outlet side walls 416 are inclined, or angled, relative to the (center) outlet slot 311 disposed along the injector longitudinal axis $L_{INJ}$.

Moreover, the struts 365, 366 include planar sides 375, 376 and arcuate sides 385, 386 that are joined at a strut leading edge and that taper from a narrow dimension at the leading edge end wall 412 to a wider dimension at the trailing edge end wall 414. The flow diverters 364, 367 have an opposing dimensional change and protrude a first (larger) distance into the outlet flow paths at the leading edge end 412 and protrude a second (smaller) distance into the flow paths at the trailing edge end 414. As a result, a first outlet flow path 311 is defined along the longitudinal axis $L_{INJ}$ between the planar sides 375, 376 of the struts 365, 366. Additional flow paths 411 are defined between the arcuate side wall 385 of the strut 365 and the flow diverter 364 disposed along one of the outlet side walls 416 and between the arcuate side wall 386 of the strut 366 and the flow diverter 367 disposed along the opposite outlet side wall 416.

Figure 9:
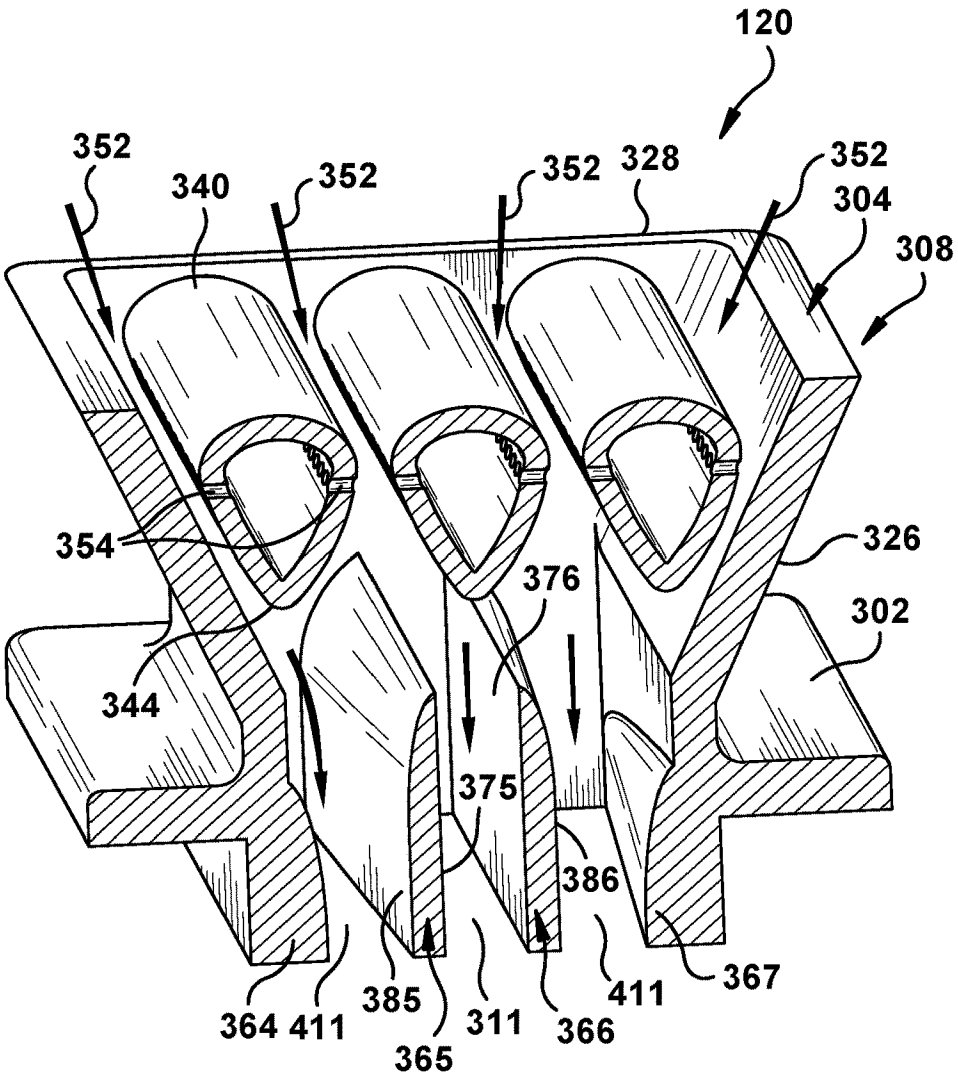
FIG. 9 is a cross-sectional perspective view of the fuel injector of FIGS. 5 and 8.
Figure 8:
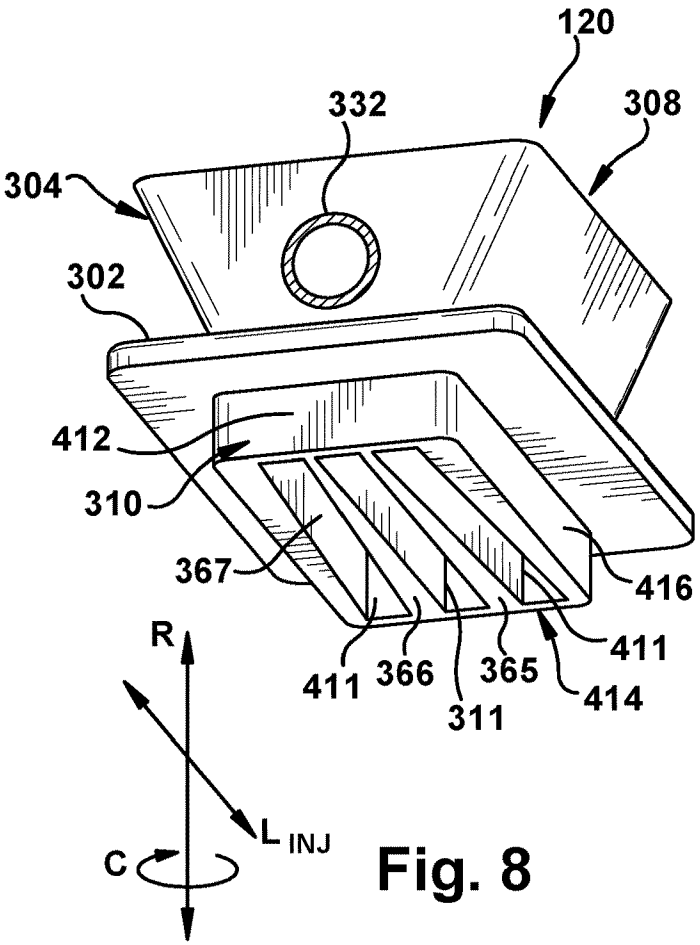
FIG. 8 is a bottom perspective view of the fuel injector of FIG. 5, according to another embodiment.
Figure 11:
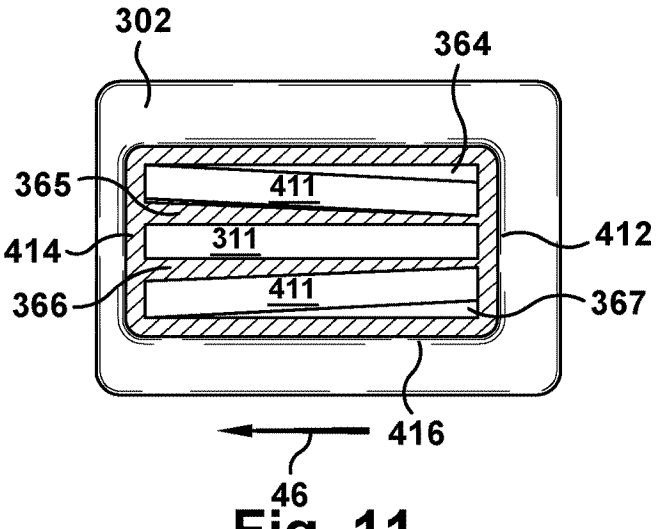
FIG. 11 is a cross-sectional view of the fuel injector of FIG. 10, as taken along line 11-11.
Figure 12:
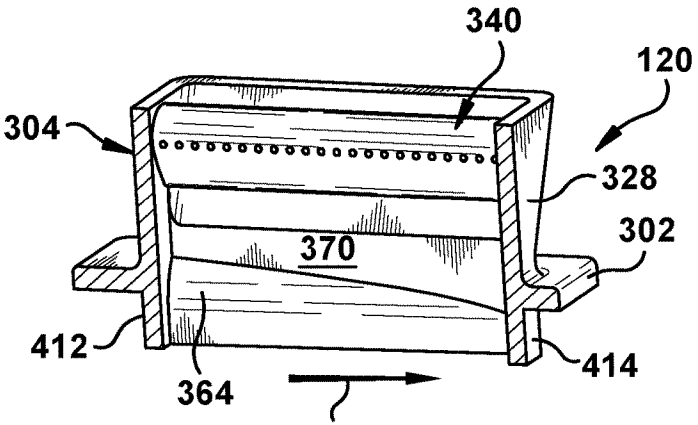
FIG. 12 is a cross-sectional view of the fuel injector of FIG. 10, as taken along line 12-12.
Figure 10:
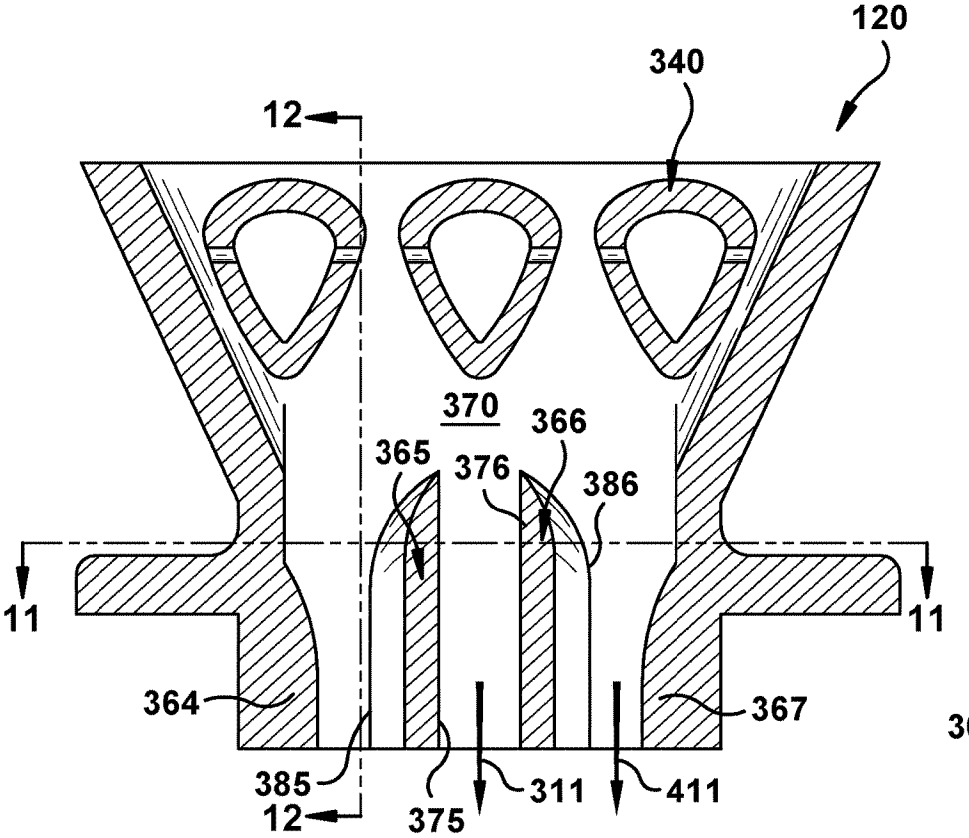
FIG. 10 is a cross-sectional view of the fuel injector of FIGS. 5 and 8.

FIGS. 9 and 10 are cross-sectional views looking downstream toward the trailing edge end wall 414. FIG. 11 is a cross-sectional view of FIG. 10, as taken along line 11-11. In this view, the flow of combustion gases 46 from the primary combustion zone 50 moves in a right-to-left direction, as indicated by the arrow. FIG. 12 is a cross-sectional view of FIG. 10, as taken along line 12-12. In this view, the flow of combustion gases 46 from the primary combustion zone 50 moves in a left-to-right direction, as indicated by the arrow.

In the embodiments illustrated in FIGS. 2 through 12, the fuel injection bodies 340 are held within a common frame 304 and supply a fuel/air mixture through discrete flow paths 311 (411) in a common outlet member 310. However, it is possible to group two or more injectors 500, each having its own frame 504 and a single fuel injection body 540, to achieve similar results. Such embodiments are illustrated in FIGS. 13 through 19.

Figure 14:
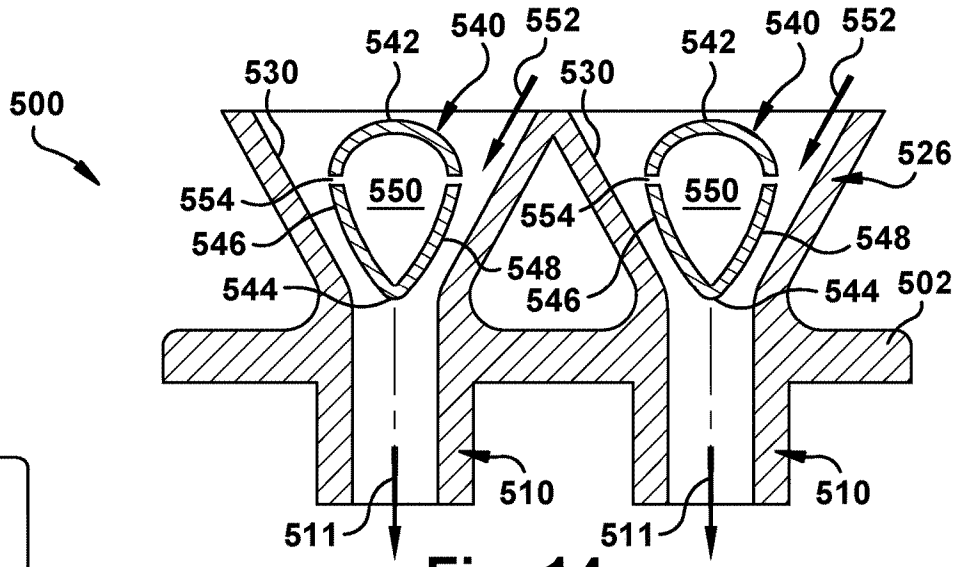
FIG. 14 is a cross-sectional view of the fuel injector of FIG. 13.
Figure 13:
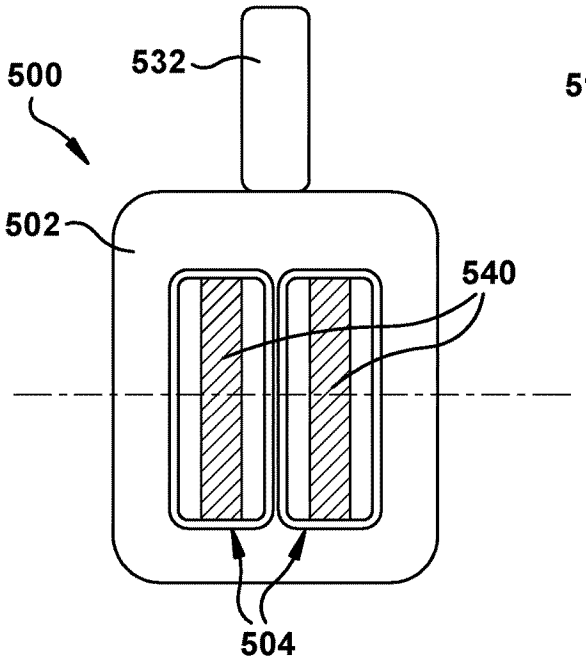
FIG. 13 is a schematic representation of an alternate fuel injector having a pair of aligned fuel injection bodies, according to an aspect of the present disclosure.

FIG. 13 provides a schematic overhead view of a fuel injector 500 having a pair of parallel, axially aligned frames 504, each frame 504 containing a single fuel injection body 540, which functions similarly to the fuel injection bodies 340 described herein. The frames 504 extend radially outward from a common, or shared, mounting flange 502, as shown in FIG. 14. The fuel injection bodies 540 include a leading edge 542, a trailing edge 544, and a pair of fuel injection surfaces 546, 548 connecting the leading edge 542 to the trailing edge 544. The fuel injection bodies 540 define therein a fuel plenum 550, which is in flow communication with a fuel conduit (not shown). Fuel from the fuel plenum 550 is delivered into a respective inlet flow path 352 defined between an interior surface 530 of a frame side wall 526 and a respective fuel injection surface 546, 548, via fuel injection ports 554 defined in the respective fuel injection surfaces 546, 548.

Figure 15:
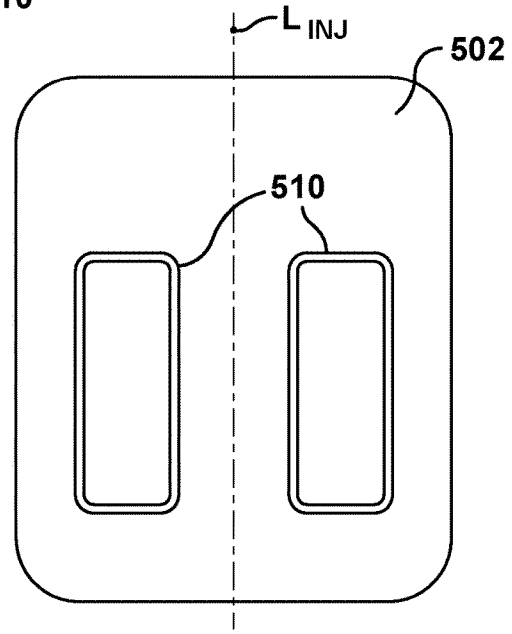
FIG. 15 is a schematic representation of outlet ducts of the fuel injector of FIG. 13.

As shown in FIGS. 14 and 15, the fuel injector 500 includes a pair of parallel and axially aligned outlet members 510 that extend radially inward from the mounting flange 502 (relative to the longitudinal axis of the combustor). The fuel/air mixture is delivered along discrete and circumferentially spaced outlet flow paths 511.

Figure 17:
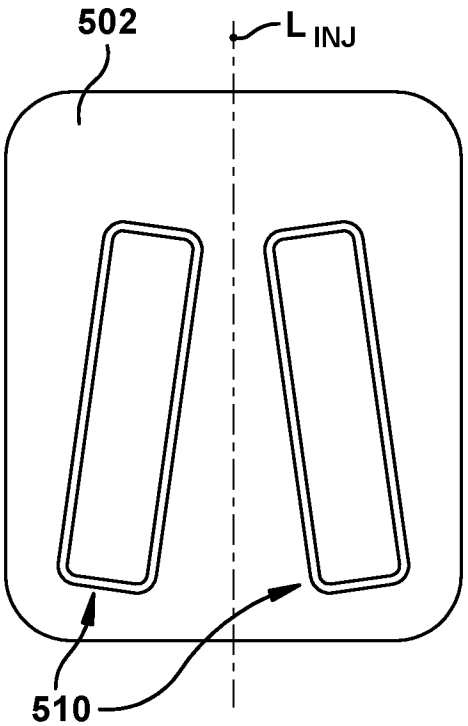
FIG. 17 is a schematic representation of outlet ducts of the fuel injector of FIG. 16.
Figure 16:
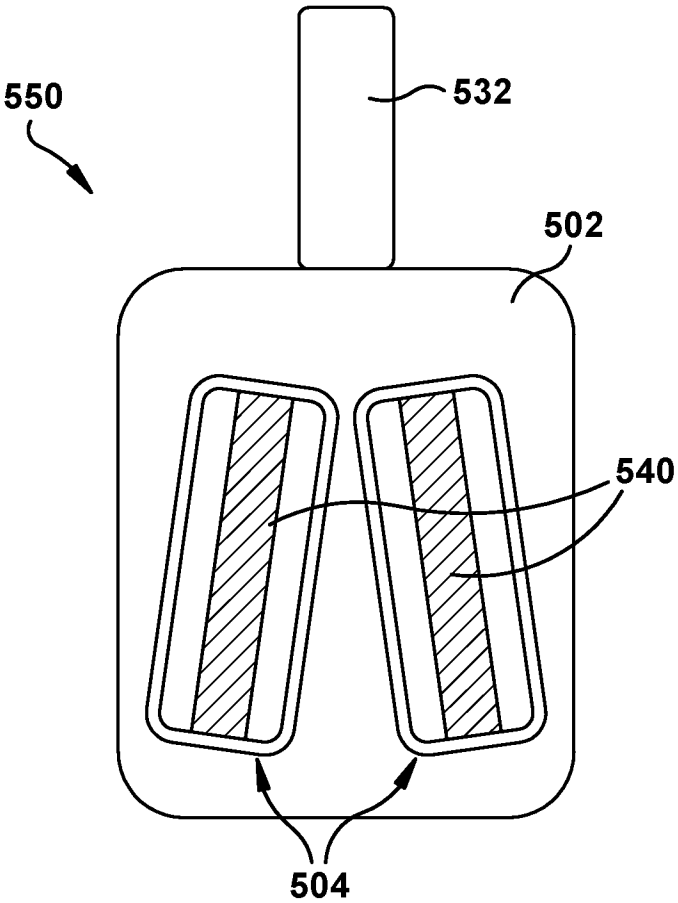
FIG. 16 is a schematic representation of an alternate fuel injector having a pair of angled fuel injection bodies, according to an aspect of the present disclosure.

FIGS. 16 and 17 schematically illustrate a fuel injector 550 having a pair of frames 504, each frame 504 containing the fuel injection body 540 described above and extending radially outward from the common, or shared, mounting flange 502. In the fuel injector 550, the frames 504 (and, therefore, the fuel injection bodies 540 and the respective outlet members 510) are inclined relative to the longitudinal axis of the injector ($L_{INJ}$), such that the frames 504 are closer to one another at a leading edge of the fuel injector 550 and further apart at a trailing edge end of the fuel injector 550.

Figure 19:
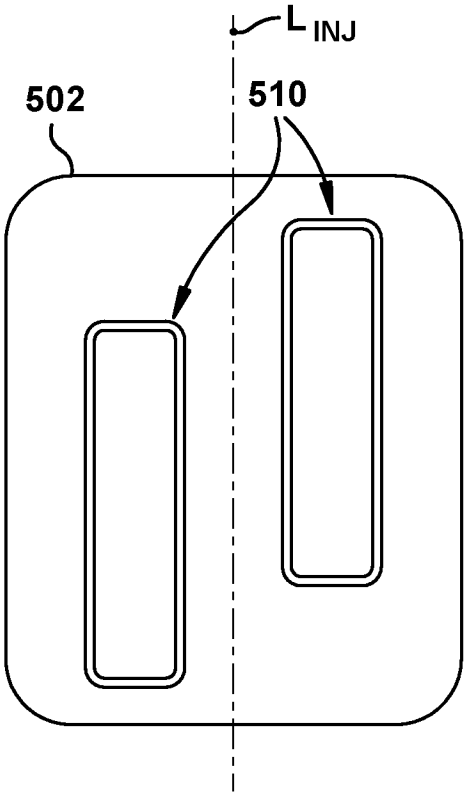
FIG. 19 is a schematic representation of outlet ducts of the fuel injector of FIG. 18.
Figure 18:
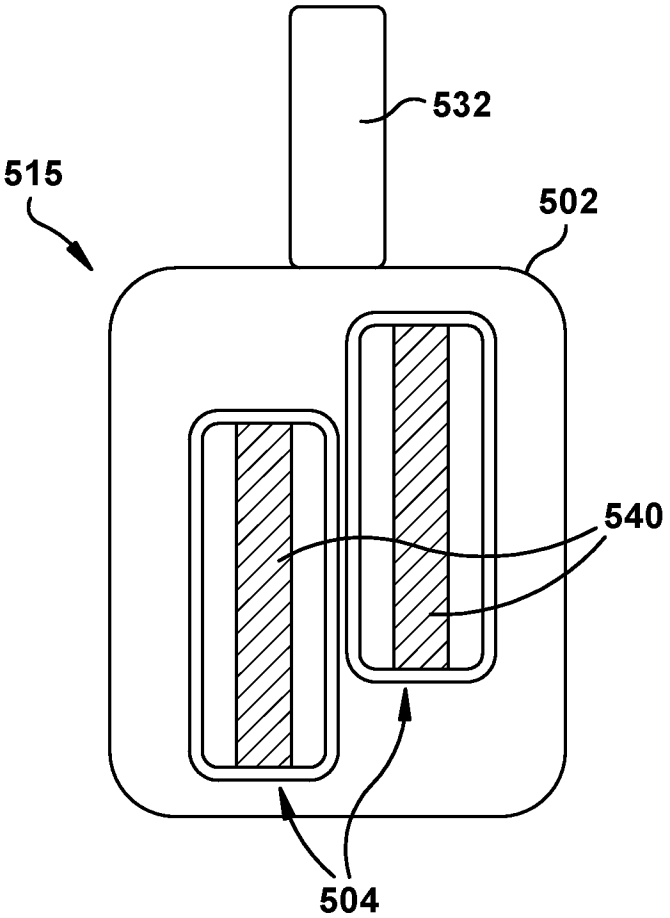
FIG. 18 is a schematic representation of an alternate fuel injector having a pair of axially staggered, parallel fuel injection bodies, according to an aspect of the present disclosure.

FIGS. 18 and 19 schematically illustrate a fuel injector 515 having a pair of frames 504, each frame containing the fuel injection body 540 described above and extending radially outward from the common, or shared, mounting flange 502. In the fuel injector 515, the frames 504 (and, therefore, the fuel injection bodies 520 and the respective outlet members 510) are parallel to one another and are axially offset relative to one another.

In any of the fuel injectors 500, 550, and 515 described above, although only two frames 504 and respective fuel injection bodies 540 are illustrated, it should be understood that multiple frames 504 may be joined to a common mounting flange 502. Moreover, the frames 504 and their respective outlet members 510 may be configured in parallel, axially staggered, and inclined configurations, or combinations thereof, as so desired.

Referring now to both the double- and triple-injection body fuel injectors (e.g., 100, 110) described herein, during certain operations of the combustion can 10, compressed gas flows into the frame 340 and through the flow paths 352. Simultaneously, fuel is conveyed through the fuel supply line 104 and through the conduit fitting 332 to the internal plenum(s) 350 of fuel injection bodies 340. Fuel passes from the plenum 350 through the fuel injection ports 354 on the fuel injection surfaces 346 and/or 348 of each fuel injection body 340, in a substantially radial direction relative to the injection axis 312, and into the inlet flow paths 352, where the fuel mixes with the compressed air. The fuel and the compressed air form the second fuel/air mixture 56, which is injected through the outlet slots 311 (and 411) of the outlet member 310 into the secondary combustion zone 60 (as shown in FIG. 1).

The present injectors with multiple outlet slots offer the following benefits over a comparable injector having a single outlet slot: increased flame surface area; enhanced mixing of the jets of the second fuel/air mixture into the combustion product stream; reduced liner length (due to enhanced mixing and more rapid combustion of the second fuel/air mixtures); and larger capacity for increased volumetric flow through the injectors (i.e., higher fuel/air splits with the fuel nozzles in the head end). It has been estimated that the present injectors provide levels of NOx emissions that are comparable with, or lower than, those associated with a similar injector having a single outlet slot.

It should be appreciated that the exemplary injectors illustrated herein may be modified to optimize their performance without departing from the spirit and scope of the present disclosure. Characteristics that may be modified include the length of the outlet slots, the width of the outlet slots, the ratio of the length of the outlet slots versus the width of the outlet slots, the gap between adjacent outlet slots, the relative axial position of the outlet slots to one another, the relative inclination (angle) of the outlet slots to one another, and the corner radius of the outlet slots.

The systems described herein facilitate enhanced mixing of fuel and compressed gas in a combustor. More specifically, the present systems facilitate directing a fuel/air mixture through at least two outlet slots that are parallel or inclined relative to one another and that may be axially staggered, or off-set. Thus, the systems facilitate enhanced mixing of fuel and compressed gas in a fuel injector of an AFS system in a turbine assembly. The systems therefore facilitate improving the overall operating efficiency of a combustor such as, for example, a combustor in a turbine assembly. This increases the output and reduces the cost associated with operating a combustor such as, for example, a combustor in a turbine assembly.

Exemplary embodiments of fuel injectors and methods of fabricating the same are described above in detail. The systems described herein are not limited to the specific embodiments described herein, but rather, components of the systems may be utilized independently and separately from other components described herein. For example, the systems described herein may have other applications not limited to practice with turbine assemblies, as described herein. Rather, the systems described herein can be implemented and utilized in connection with various other industries.

While the invention has been described in terms of various specific embodiments, those skilled in the art will recognize that the invention can be practiced with modification within the spirit and scope of the appended claims.

What is claimed is:

1. A fuel injector comprising:

a frame having interior sides defining an opening, for passage of compressed air from a plenum defined within a compressor discharge case surrounding a combustor;

a first fuel injection body and a second fuel injection body, the first fuel injection body and the second fuel injection body being coupled to the frame and being positioned within the opening such that inlet flow paths for the compressed air are defined at least between the interior sides of the frame and the first fuel injection body and between the interior sides of the frame and the second fuel injection body, wherein the first fuel injection body defines a first fuel plenum, the second fuel injection body defines a second fuel plenum, and each of the first fuel injection body and the second fuel injection body includes at least one fuel injection surface defining a plurality of fuel injection holes in communication with the respective first or second fuel plenum;

an outlet member downstream of and in fluid communication with the inlet flow paths, the outlet member comprising:

a pair of struts configured to produce discrete outlet flow paths exiting the outlet member, a leading edge end wall, a trailing edge end wall substantially parallel to the leading edge end wall, and a pair of outlet side walls connecting the leading edge end wall and the trailing edge end wall, and wherein the pair of struts extends longitudinally from the leading edge end wall to the trailing edge end wall; and wherein the fuel injector is configured to be mounted to an external surface of the combustor to inject a mixture of compressed air and fuel through a liner of the combustor.

2. The fuel injector of claim 1, further comprising a conduit fitting coupled to the frame and fluidly connected to each of the first fuel plenum and the second fuel plenum; and wherein the conduit fitting is fluidly connected to a fuel supply line.

3. The fuel injector of claim 1, wherein each strut of the pair of struts comprises a shape diverging in a direction of flow through the fuel injector, each strut of the pair of struts having a leading edge proximate to at least one of the first fuel injection body and the second fuel injection body and a trailing edge opposite the leading edge.

4. The fuel injector of claim 1, further comprising a third fuel injection body; and wherein a number of inlet flow paths is greater than a number of outlet flow paths.

5. The fuel injector of claim 1, wherein each strut of the pair of struts comprises a planar surface and an arcuate surface, the planar surface and the arcuate surface being connected at a leading edge; and wherein the pair of struts is disposed with the planar surface of a first strut being adjacent the planar surface of a second strut to define a central outlet slot therebetween.

6. The fuel injector of claim 4, wherein each strut of the pair of struts tapers from a narrow dimension at the leading edge end wall to a wider dimension at the trailing edge end wall.

7. The fuel injector of claim 6, further comprising a first flow diverter disposed along a first outlet side wall of the pair of outlet side walls, and a second flow diverter disposed along a second outlet side wall of the pair of outlet side walls; and wherein the first flow diverter and the second flow diverter protrude into the outlet flow paths.

8. The fuel injector of claim 7, wherein the first flow diverter and the second flow diverter protrude a first distance into the outlet flow paths from the leading edge end wall to a second distance at the trailing edge end wall, the first distance being larger than the second distance; and wherein the outlet flow paths comprise a center outlet flow path along a longitudinal axis of the fuel injector, a first outlet flow path inclined in a first direction relative to the longitudinal axis of the fuel injector, and a second outlet flow path inclined in a second direction relative to the longitudinal axis of the fuel injector.

9. The fuel injector of claim 8, wherein the center outlet flow path, the first outlet flow path, and the second outlet flow path are proximate one another at the leading edge end wall; and wherein the first outlet flow path and the second outlet flow path are inclined away from the longitudinal axis at the trailing edge end wall.

10. The fuel injector of claim 1, further comprising a mounting flange disposed between the frame and the outlet member, the mounting flange securing the fuel injector to the external surface of the combustor.

* * * * *